US009844801B2

(12) United States Patent
Kim et al.

(10) Patent No.: US 9,844,801 B2
(45) Date of Patent: Dec. 19, 2017

(54) DISHWASHER

(71) Applicant: LG ELECTRONICS INC., Seoul (KR)

(72) Inventors: Seongho Kim, Seoul (KR); Jaechul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 14/738,290

(22) Filed: Jun. 12, 2015

(65) Prior Publication Data

US 2015/0359411 A1 Dec. 17, 2015

(30) Foreign Application Priority Data

Jun. 12, 2014 (KR) ..... 10-2014-0071649

(51) Int. Cl.

*B08B 3/10* (2006.01)
*B08B 7/04* (2006.01)
*A47L 15/00* (2006.01)
(Continued)

(52) U.S. Cl.

CPC ..... *B08B 3/10* (2013.01); *A47L 15/0049* (2013.01); *A47L 15/4244* (2013.01);
(Continued)

(58) Field of Classification Search

CPC ..... B08B 3/10; B08B 7/04; A47L 15/0049; A47L 15/4285; A47L 15/4244;
(Continued)

(56) References Cited

U.S. PATENT DOCUMENTS 5,158,436 A * 10/1992 Jensen ..... H02H 7/0833 417/32
9,339,167 B2 * 5/2016 Kim ..... A47L 15/4206
(Continued)

FOREIGN PATENT DOCUMENTS

CN 1567109 1/2005
CN 1681195 10/2005
(Continued)

OTHER PUBLICATIONS

European Search Report dated Oct. 20, 2015 for European Application No. 15171571.1, 6 pages.
(Continued)

*Primary Examiner* — Saeed T Chaudhry
(74) *Attorney, Agent, or Firm* — Fish & Richardson P.C.

(57) ABSTRACT

A control method for a dishwasher that includes a spray arm, a sump configured to provide a space where washing water is stored and to collect washing water sprayed from the spray arm, a housing configured to connect the sump and the spray arm, a heater located in the housing, an impeller located in the housing and above the heater, and a motor configured to rotate the impeller, is described. The control method includes the actions of supplying washing water to the sump; rotating the impeller by supplying electricity to the motor; measuring an amount of electric current supplied to the motor during the rotating of the impeller; and heating washing water located in the housing by operating the heater based on the amount of electric current supplied to the motor during the rotating of the impeller being greater than or equal to a preset reference amount.

11 Claims, 3 Drawing Sheets

(51) Int. Cl.
*A47L 15/42* (2006.01)
*B08B 3/02* (2006.01)

(52) U.S. Cl.
CPC ..... *A47L 15/4285* (2013.01); *B08B 3/024* (2013.01); *B08B 7/04* (2013.01); *A47L 15/4225* (2013.01); *A47L 15/4234* (2013.01); *A47L 2401/08* (2013.01); *A47L 2401/09* (2013.01); *A47L 2501/01* (2013.01); *A47L 2501/05* (2013.01); *A47L 2501/06* (2013.01)

(58) Field of Classification Search
CPC ..... A47L 15/4234; A47L 15/4225; A47L 2501/01; A47L 2501/05; A47L 2501/06; A47L 2401/08; A47L 2401/09
See application file for complete search history.

(56) References Cited

U.S. PATENT DOCUMENTS

| | | | | |
|---|---|---|---|---|
| 2007/0163626 | A1* | 7/2007 | Klein | A47L 15/0049 134/56 D |
| 2011/0277794 | A1* | 11/2011 | King | A47L 15/0023 134/18 |

FOREIGN PATENT DOCUMENTS

| | | | |
|---|---|---|---|
| CN | 1957832 | | 5/2007 |
| CN | 101674768 | | 3/2010 |
| CN | 103197612 | | 7/2013 |
| DE | 102011051356 | A1 | 12/2012 |
| EP | 1 566 477 | A1 | 8/2005 |
| EP | 1 762 169 | A2 | 3/2007 |
| JP | H07-313427 | | 12/1995 |
| JP | 2000-083887 | | 3/2000 |
| JP | 2006-006766 | | 1/2006 |
| JP | 4759583 | | 8/2011 |
| KR | 10-0681081 | | 2/2007 |
| KR | 10-0722017 | | 5/2007 |

OTHER PUBLICATIONS

Office Action issued in Australian Application No. 2015203124 dated Feb. 22, 2016, 4 pages.
Chinese Office Action in Chinese Application No. 201510319165.X dated Jul. 5, 2017, 18 pages (with English translation).

* cited by examiner

【Figure 1】
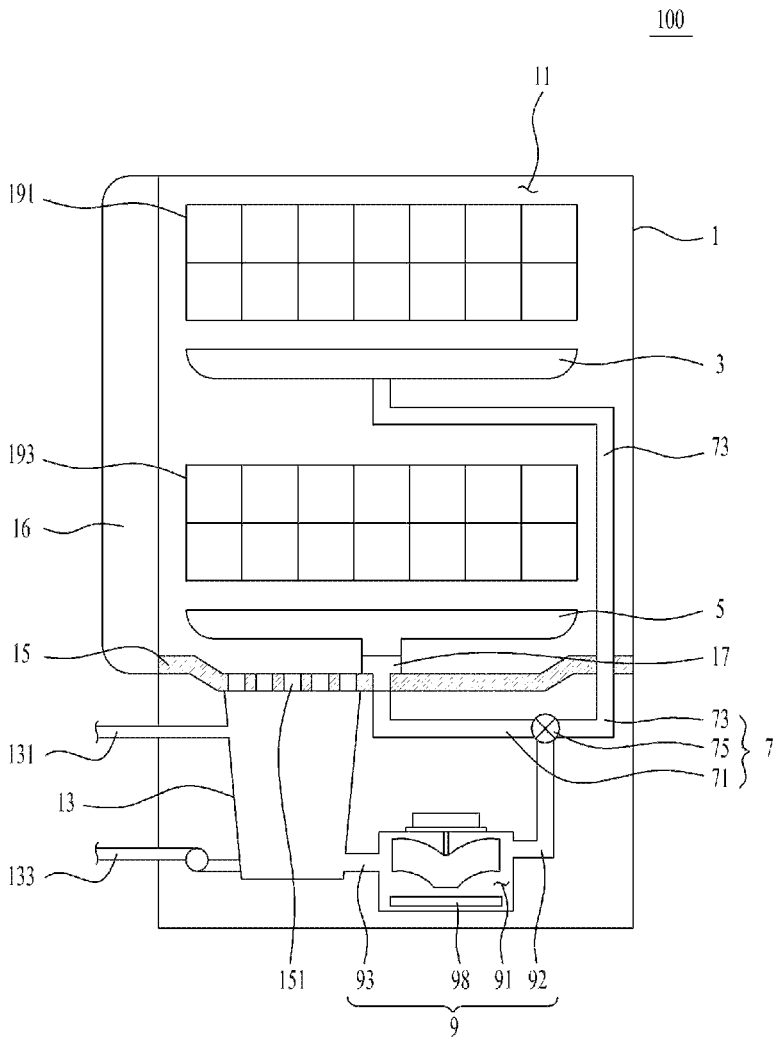

【Figure 2】
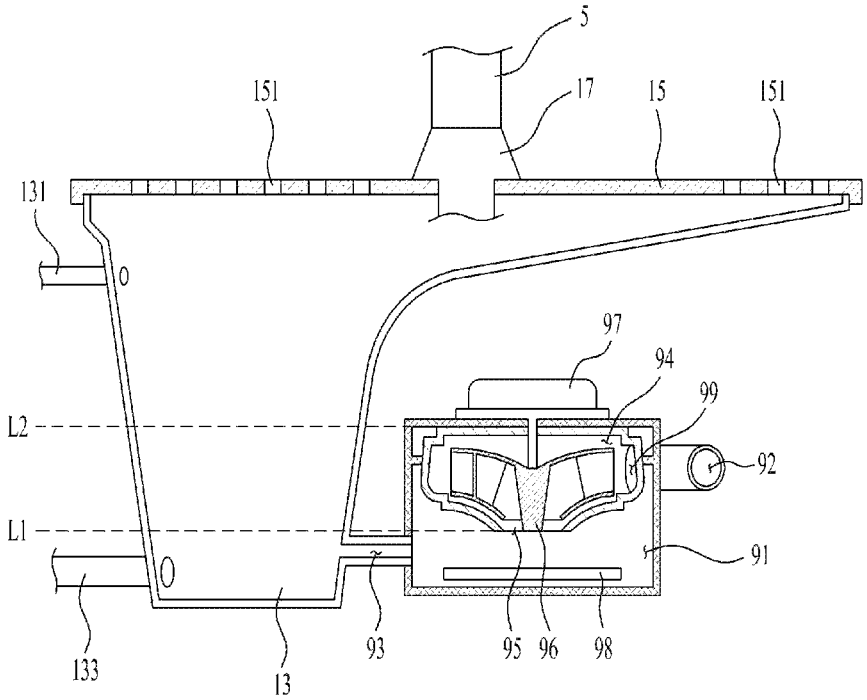

【Figure 3】
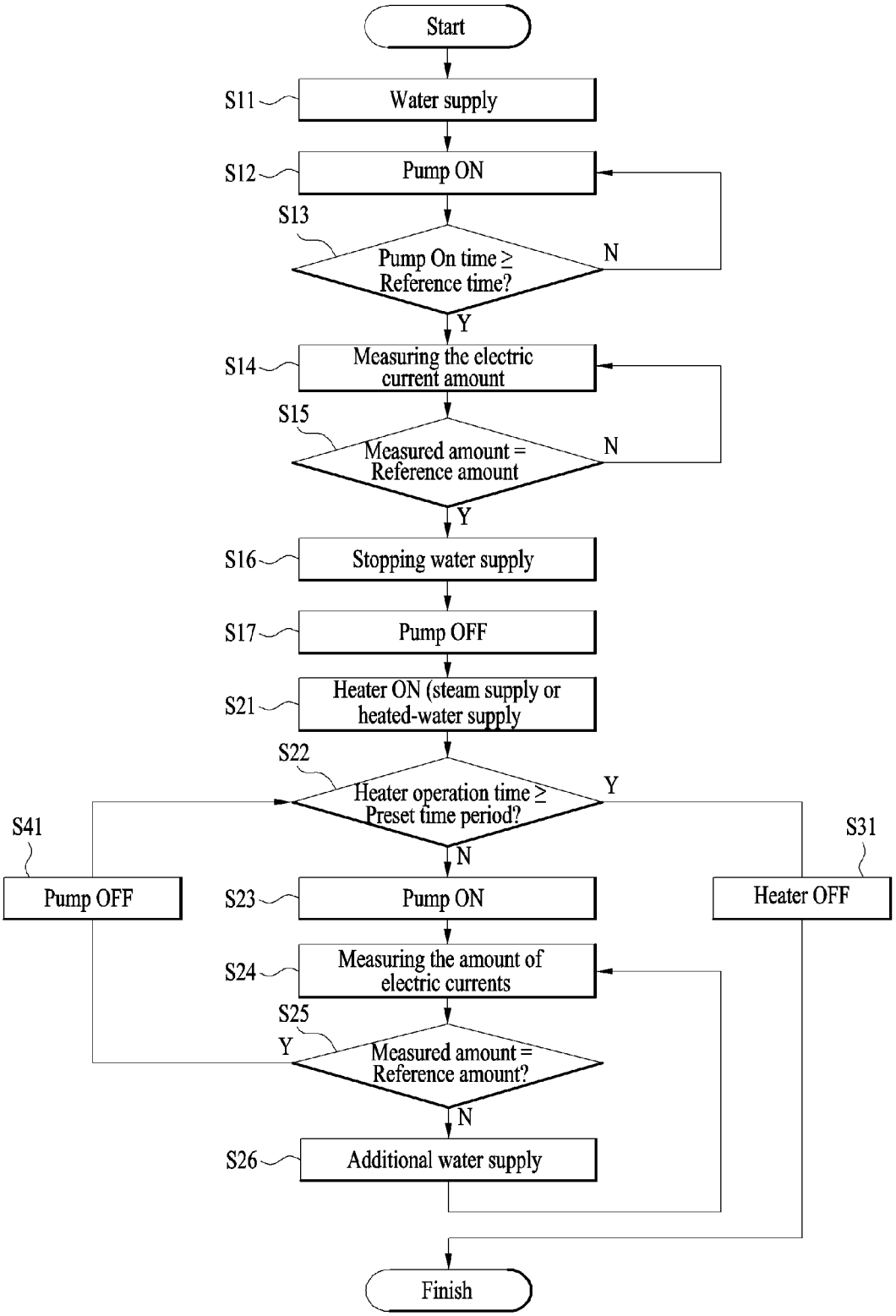

DISHWASHER

CROSS-REFERENCE TO RELATED APPLICATIONS

This application claims priority to Korean Patent Application No. 10-2014-0071649 filed on Jun. 12, 2014 in Korea, the entire contents of which is hereby incorporated by reference in its entirety.

FIELD

The present disclosure relates to a dishwasher and a control method for a dishwasher.

BACKGROUND

Dishwashers are electric home appliances for washing contaminants such as scraps or leftover food on dishes or cookware (hereinafter, "washing objects"), using washing-up liquid and washing water.

A conventional dishwasher usually includes a tub configured to provide a washing space, a dish rack provided in the tub to receive washing objects thereon, and a spraying arm for spraying washing water to the dish rack.

Meanwhile, some of the conventional dishwashers further include a storage space for storing the water which will be used in generating the heated-water or steam supplied to the washing objects, and a heater provided in the storage space.

SUMMARY

According to an innovative aspect of the subject matter described in this application, a control method of a dishwasher that includes a spray arm configured to spray washing water to a washing object, a sump configured to provide a space where washing water is stored and to collect washing water sprayed from the spray arm, a housing configured to connect the sump and the spray arm, a heater located in the housing, an impeller located in the housing and above the heater, and a motor configured to rotate the impeller, includes the actions of supplying washing water to the sump; rotating the impeller by supplying electricity to the motor; measuring an amount of electric current supplied to the motor during the rotating of the impeller; and heating washing water located in the housing by operating the heater based on the amount of electric current supplied to the motor during the rotating of the impeller being greater than or equal to a preset reference amount.

The method may include one or more of the following optional features. The impeller rotates at a preset revolutions per minute (RPM) that is higher than an RPM of the impeller to spray washing water from the spray arm and lower than an RPM of the impeller to cause washing water sprayed from the spray arm to contact the washing object. The amount of the electric current supplied to the motor during the rotating of the impeller in a water level that at least contacts with the impeller, is designated as the preset reference amount. The action of measuring the amount of electric current supplied to the motor during the rotating of the impeller includes, during a preset reference time period after beginning to rotate the impeller by supplying electricity to the motor, measuring the amount of electric current supplied to the motor during the rotating of the impeller.

The actions further include repeating the rotating of the impeller, using electric current supplied to the motor during the heating of washing water; repeating the measuring of the amount of electric current supplied to the motor during the repeating of the rotating of the impeller using electric current supplied to the motor during the heating of washing water; and repeating the supplying of washing water to the sump, based on the amount of the electric current supplied to the motor during the repeating of the rotating of the impeller using electric current supplied to the motor during the heating of washing water not being equal to the preset reference amount. The actions further include the action of, based on the amount of electric current supplied to the motor during the rotating of the impeller being greater than or equal to the preset reference amount, stopping supply of washing water to the sump and stopping rotation of the impeller.

The preset reference amount is a range having a minimum amount and a maximum amount of electric current. The heating of washing water located in the housing and the repeating of the supplying washing water comprise, based on the measured amount of electric current supplied to the motor during the rotating of the impeller being in the range, heating of washing water located in the housing and repeating the supplying of washing water. The amount of electric current supplied to the motor, based on the impeller rotating with a water level at least contacting the impeller, is designated as the minimum amount of electric current. The amount of electric current supplied to the motor, based on the impeller rotating with the water level greater than or equal to a highest level of the housing, is designated as the maximum amount of electric current.

According to another innovative aspect of the subject matter described in this application, a dishwasher includes a tub configured to provide a washing space; a rack provided in the tub and configured to hold washing objects; a spray arm located under the rack and configured to spray washing water to the washing objects; a sump configured to provide a space where washing water is stored and to collect washing water sprayed from the spray arm; a housing connected to the sump via an inlet and to the spray arm via an outlet; an impeller rotatably located in the housing and configured to move washing water to the outlet; a motor located outside the housing and configured to rotate the impeller; a heater located in the housing and under the impeller; and a control unit configured to operate the heater based on the amount of electric current supplied to the motor.

The dishwasher may include the following optional feature. The control unit operates the heater based on the amount of the electric current supplied to the motor being greater than or equal to a preset reference amount.

It is an object of the subject matter described in this application to provide a dishwasher that may sense a level of the water stored in a space having a heater, using a pump configured to supply washing water to a spray arm.

BRIEF DESCRIPTION OF THE DRAWINGS

FIG. 1 is a diagram of an example dishwasher.

FIG. 2 is a diagram of an example pump located in a dishwasher.

FIG. 3 is a flow chart for an example control method for a dishwasher.

DETAILED DESCRIPTION

FIG. 1 illustrates an example dishwasher. The dishwasher 100 includes a cabinet 1 configured to define an exterior appearance of the dishwasher 100; a tub 11 provided in the cabinet and configured to provide a washing space; a sump 13, e.g., a system that re-collects the washing water stored in the tub; and a door 16 coupled to the cabinet to open and close the washing space.

The tub 11 and the sump 13 are partitioned off from each other by a cover 15 provided above the sump. A collecting hole 151 is provided in the cover 15 to make the tub 11 and the sup 13 communicate with each other.

The sump 13 includes a water supply path 131 configured to supply washing water and a drainage path 133 configured to drain the washing water from the sump.

The tub 11 may include racks on which washing objects, e.g., dishes, are placed. The racks include a first rack 191 and a second rack 193 provided under the first rack. For convenience sake, the first rack is called an upper rack and the second rack 193 is called a lower rack.

The upper rack 191 and the lower rack 193 are configured to be pulled out of the tub 11, when the door 16 opens the washing space. For that, a rail may be provided in an inner circumferential surface of the tub from a rear surface of the dishwasher to a front surface where the door 16 is provided. Wheels may be further provided in the upper and lower racks to support the racks, respectively.

In some implementations, the dishwasher may include a lower arm 5 provided in the tub 11 and configured to wash the washing objects placed on the lower rack 193 and an upper arm 3 provided in the tub to wash the washing objects placed on the upper rack 191.

The lower arm 5 and the upper arm 3 are provided with the washing water via a pump and a supply path 7.

The supply path 5 includes a first supply path 71 connected to the lower arm 5 via an arm holder 17 provided in the cover 15 and a second supply path 73 connected to the upper arm 3. The supply paths 71 and 73 are opened and closed by a flow-path transfer valve 75.

A control unit may control the flow-path transfer valve 75 to open the supply path 71 or 73 selectively or to open the supply paths simultaneously.

As shown in FIG. 2, the pump 9 may include a housing 91 connected to the pump 13 via an inlet 93, an outlet 92 configured to connect the housing 91 and the path-flow transfer valve 75 with each other, an impeller 96 provided in the housing 91 to flow the washing water stored in the housing to the outlet 92, and a motor 97 provided outside the housing to rotate the impeller 96.

The impeller 96 may be provided in an impeller accommodating portion 94 provided in the housing 91.

The impeller accommodating portion 94 may define a space where the impeller 96 is provided and provide a path of the washing water held in the housing 91 to the outlet 92.

The impeller accommodating portion 94 may include an accommodating portion inlet hole 95 in communication with an inside of the housing 91 and an accommodating portion outlet hole 99 in communication with the outlet 92.

When the impeller 96 is rotated by the motor 97 provided with the electric power, the washing water supplied to the housing from the sump 13 is flowing to the impeller accommodating portion 95 via the accommodating portion inlet hole 95 and then flowing to the flow-path transfer valve 75 via the accommodating portion outlet hole 99 and the outlet unit 92.

The water supplied to the flow-path transfer valve 75 is flowing to the spray arms 3 and 5 along the supply paths 71 and 73 opened by the path-flow transfer valve 75.

In some implementations, the dishwasher 100 may further a heater 98 configured to heat the water stored in the housing 91 so as to supply heated-water or steam to the spray arms 3 and 5.

The heater 98 may be provided in the housing 91 and, in some implementations, that the heater 98 is provided under the impeller 96, e.g., under the accommodating portion inlet hole 95.

When it is provided under the impeller 96, the heater 98 may measure the repulsive power of the washing water which acts for the impeller 96 rotated by the motor, e.g., the load of the impeller or the load of the motor so as to determine whether the heater 98 is submerged in the washing water or not.

As a water level inside the housing 91 is getting higher, the load of the impeller 96 is increasing more. Accordingly, the load of the impeller 96 measured when the water level in the housing 91 is a reference level (L1) which contacts with a bottom surface of the impeller 96 may be set as a reference load. When the reference load is compared with the load of the impeller 96 measured during the operation of the dishwasher after that, the water level in the housing 91 may be kept above the reference water level (L1) such that the overheat of the heater 98 can be prevented.

According to a method for measuring the load of the impeller 96, the load of the impeller 96 is determined based on the amount of electricity supplied to the motor 97 after the motor 97 is operated for the impeller 96 to keep a uniform revolutions per minute (RPM).

When the water level in the housing 91 is substantially high, the load of the impeller 96 is increasing and the amount of the electricity, or electric currents, that has to be supplied to the impeller 96 is also increasing. When the water level in the housing 91 is substantially low, the load of the impeller 96 is decreasing and the amount of the electricity, or electric currents, that have to be supplied to the impeller 96 is also decreasing.

In case the motor 97 is provided with the uniform-sized electricity continuously, the load of the impeller 96 may be determined based on the measured RPM of the impeller 96 to measure the load of the impeller.

FIG. 3 illustrates an example control method for a dishwasher. The control method is characterized in that the water level in the housing 91 where the heater 98 is provided may be measured, using the pump 9 configured to supply the washing water to the spray arms 3 and 5.

The control method includes a water supply step (S11) of supplying the washing water to the sump 13 via the water supply path 131. Once the washing water is supplied to the sump 13 in the water supply step (S11), the washing water inside the sump 13 may be supplied to the housing 91 via the inlet 93.

In a preset time period when the water supply step (S11) starts, the control method includes a driving step (S12) of rotating the impeller 96, using the electricity supplied to the motor 97.

The driving step (S12) is a step for rotating the impeller 96 so as to detect the water level in the housing 91, so that the control unit may control the flow-path transfer valve 75 to supply the washing water to the lower arm 5.

The path for collecting the water in the sump after the lower arm 5 is shorter than the path for collecting the water in the sump after the upper arm 3. Accordingly, the time taken to collect the water in the sump 13 after passing the lower arm 5 is shorter than the time taken to collect the water in the sump 13 after passing the upper arm 3. The water level in the housing 91 may be measured more precisely when the pump 9 supplies the washing water to the lower arm 5 than when it supplies the washing water to the upper arm 3.

Meanwhile, an object of the driving step (S12) is not to spray the washing water so as to wash the washing objects but to spray the washing water to the spray arm so as to detect the water level in the housing 91. Accordingly, in some implementations, the driving step (S12) that the impeller 96 is driven at a preset RPM which is higher than the RPM at which the impeller is driven to drain the washing water from the lower arm 5 and lower than the RPM at which the impeller is driven so as to make the washing water sprayed from the lower arm 5 to the washing objects that may be held in the lower rack 193.

The driving step (S12) mentioned above may be performed for a preset measurement reference time period. In a preset reference time period after the driving step (S12) starts (S13, the reference time period is less than the measurement reference time), the control method includes a measuring step (S14) of measuring the amount of the electric currents supplied to the motor 97.

In an initial stage of the operation of the pump 9, air could remain in the first supply path 21 or the second supply path 23 and the air could be sucked into the impeller 96 according to the water level in the housing 91.

When air remains in the supply path 21 or 23 or air is sucked into the impeller 96, the load of the impeller could fails to be uniform and it could be difficult to measure the amount of the electric currents supplied to the motor 97. Accordingly, when the measuring step (S14) is performed in a reference time period after the electricity starts to be supplied to the pump 9, the load of the motor 97 may be measured precisely and the load of the impeller may be then determined precisely and effectively.

Once the measuring step (S14) is completed, the control method may include a comparing step (S15) of comparing the measured amount of the electric currents with the reference amount of electric currents.

The experimental number of the electricity, or electric currents, supplied to the motor 97, when the driving step (S12) is performed in a state where the water level in the housing 91 is the water level (the reference water level, L1) or higher at which the water contacts with the impeller 96, may be set as the reference amount of the electric currents.

Meanwhile, the reference amount of the electric currents may be set in a range having the minimum amount and the maximum amount of the electric currents.

In this instance, the experimental number of the electricity, or electric currents, supplied to the motor 97 when the driving step (S12) is performed in a state where the water level in the housing 91 is the reference level (L1) may be set as the minimum amount of the electric currents. The experimental number of the electricity, or electric currents, supplied to the motor 97 when the driving step (S12) is performed in a state where the water level in the housing 91 is the highest water level (L2) in the housing 91.

When the amount of the electric currents measured in the measuring step (S14) is equal to the reference amount, the control method may include a water-supply stopping step (S16), a pump stopping step (S17) and a heating step (S21) of operating the heater 98 after the water-supply stopping step (S16) and the pump stopping step (S17) so as to heat the washing water.

In case the reference amount of the electric currents is set in a range having the minimum amount and the maximum amount of the electric currents, the water-supply stopping step (S16), the pump stopping step (S17) and the heating step (S21) starts when the amount of the electric currents measured in the measuring step (S14) is the minimum amount or more and the maximum amount of lower.

The heating step (S21) is the step of heating the washing water stored in the housing 91 so as to generate heated-water or steam.

The heated-water or steam generated in the heating step (S21) may be supplied to the washing objects via the spray arms along the supply paths 71 and 73 selectively open by the flow-path transfer valve 75. At this time, the steam may be supplied to the washing objects via a steam supply pipe configured to connect the housing 91 and the tub 11 with each other.

The heating step (S21) is performed for a preset time period. In other words, when it is determined (S22) that the duration time of the heating step (S21) passes the preset time period, the control method stops the operation of the heater 98 (S31) and ends the control of the dishwasher after that.

Meanwhile, during the heating step, the water level in the housing might decrease. The control method may further include a second driving step (S23) and a second measuring step (S24) to as to measure the water level in the housing 91 during the heating step (S21).

The second driving step (S23) is the step of rotating the impeller 96, using the electricity supplied to the motor 97 during the heating step. The second measuring step (S24) is the step of measuring the electric currents supplied to the motor 97 to perform the second driving step.

The RPM of the impeller in the second driving step (S23) may be equal to the RPM of the impeller in the driving step (S12) mentioned above.

In other words, in some implementations, that the RPM of the impeller 96 in the second driving step (S23) is higher than the RPM of the impeller driven to spray the washing water from the lower arm 5 and lower than the RPM of the impeller driven to make the washing water sprayed from the lower arm 5 contact with the washing objects which may be held in the lower rack 193.

Once the mount of the electric currents supplied to the motor 97 in the second driving step (S23) is measured in the second measuring step (S24), the control method performs a comparing step (S25) of comparing the amount of the electric currents measured in the second measuring step with the reference amount.

When the amount of the electric currents measured in the second measuring step (S24) is equal to the reference amount, the supply of the electricity to the motor 97 is cut off (S41) and it is determined whether a preset time set in the heating step passes.

However, when the amount of the electric currents measured in the second measuring step (S24) is not equal to the reference amount, the control method may perform an additional water supply (S26) of supplying washing water to the sump 13 and then a comparing step (S25) of comparing the measured amount with the reference amount of the electric currents.

What is claimed is:

1. A control method for a dishwasher comprising a spray arm configured to spray washing water to a washing object, a sump configured to provide a space where washing water is stored and to collect washing water sprayed from the spray arm, a housing configured to connect the sump and the spray arm, a heater located in the housing, an impeller located in the housing and above the heater, and a motor configured to rotate the impeller, the control method comprising:

supplying washing water to the sump;

rotating the impeller by supplying electricity to the motor;

during a preset reference time period after beginning to rotate the impeller by supplying electricity to the motor, measuring an amount of electric current supplied to the motor during the rotating of the impeller; and heating washing water located in the housing by operating the heater based on the amount of electric current supplied to the motor during the rotating of the impeller being greater than or equal to a preset reference amount.

2. The control method for the dishwasher of claim 1, wherein the impeller rotates at a preset revolutions per minute (RPM) that is higher than a first RPM of the impeller to initiate spraying of washing water from the spray arm and that is lower than a second RPM of the impeller to cause washing water sprayed from the spray arm to contact the washing object.

3. The control method for the dishwasher of claim 1, wherein the amount of the electric current supplied to the motor during the rotating of the impeller in a water level that at least contacts with the impeller, is designated as the preset reference amount.

4. The control method for the dishwasher of claim 1, further comprising:

repeating the rotating of the impeller, using electric current supplied to the motor during the heating of washing water;

repeating the measuring of the amount of electric current supplied to the motor during the repeating of the rotating of the impeller using electric current supplied to the motor during the heating of washing water; and repeating the supplying of washing water to the sump, based on the amount of the electric current supplied to the motor during the repeating of the rotating of the impeller using electric current supplied to the motor during the heating of washing water not being equal to the preset reference amount.

5. The control method for the dishwasher of claim 1, further comprising:

based on the amount of electric current supplied to the motor during the rotating of the impeller being greater than or equal to the preset reference amount, stopping supply of washing water to the sump and stopping rotation of the impeller.

6. The control method for the dishwasher of claim 4, wherein:

the preset reference amount is a range having a minimum amount and a maximum amount of electric current, and the heating of washing water located in the housing and the repeating of the supplying washing water comprise, based on the measured amount of electric current supplied to the motor during the rotating of the impeller being in the range, heating of washing water located in the housing and repeating the supplying of washing water.

7. The control method for the dishwasher of claim 6, wherein:

the amount of electric current supplied to the motor, based on the impeller rotating with a water level at least contacting the impeller, is designated as the minimum amount of electric current, and the amount of electric current supplied to the motor, based on the impeller rotating with the water level greater than or equal to a highest level of the housing, is designated as the maximum amount of electric current.

8. A dishwasher comprising:

a tub configured to provide a washing space;

a rack provided in the tub and configured to hold washing objects;

a spray arm located under the rack and configured to spray washing water to the washing objects;

a sump configured to provide a space where washing water is stored and to collect washing water sprayed from the spray arm;

a housing connected to the sump via an inlet and to the spray arm via an outlet;

an impeller rotatably located in the housing and configured to move washing water to the outlet;

a motor located outside the housing and configured to rotate the impeller;

a heater located in the housing and under the impeller; and a control unit configured to operate the heater based on the amount of electric current supplied to the motor.

9. The dishwasher of claim 8, wherein the control unit operates the heater based on the amount of the electric current supplied to the motor being greater than or equal to a preset reference amount.

10. The control method for the dishwasher of claim 1, wherein:

the spray arm is configured to spray washing water in a washing space, and the housing defines a housing space that is different than the washing space.

11. The dishwasher of claim 8, wherein:

the housing defines a housing space that is different than the washing space, and the impeller and the heater are located in the housing space.

* * * * *